US007862044B1

(12) United States Patent
Spelman et al.

(10) Patent No.: US 7,862,044 B1
(45) Date of Patent: Jan. 4, 2011

(54) SIMULATED FOOTBALL GAME AND A DECK OF CARDS FOR PLAYING THE SAME

(75) Inventors: Jeffrey Todd Spelman, Newport, KY (US); Lloyd Stephen Boord, Cincinnati, OH (US); Elizabeth Ann Edwards, Cincinnati, OH (US); Michelle Noelle Spelman, Newport, KY (US)

(73) Assignee: Flying Pig Games, LLC, Cincinnati, OH (US)

( * ) Notice: Subject to any disclaimer, the term of this patent is extended or adjusted under 35 U.S.C. 154(b) by 0 days.

(21) Appl. No.: 12/288,898

(22) Filed: Oct. 24, 2008

(51) Int. Cl.
*A63F 1/00* (2006.01)

(52) U.S. Cl. ..... 273/298

(58) Field of Classification Search ..... None
See application file for complete search history.

(56) References Cited

U.S. PATENT DOCUMENTS

| | | | | |
|---|---|---|---|---|
| 2,064,466 | A | 12/1936 | Downey | |
| 2,106,846 | A | 2/1938 | Katz | |
| 2,460,541 | A | 2/1949 | Siler | |
| 3,895,798 | A * | 7/1975 | Collins | 273/277 |
| 4,094,509 | A * | 6/1978 | Barron | 273/247 |
| 4,169,600 | A | 10/1979 | Rakowski | |
| 5,040,796 | A * | 8/1991 | Schall | 463/22 |
| 5,186,461 | A | 2/1993 | Tucker | |
| 5,496,036 | A | 3/1996 | Chester | |
| 5,762,338 | A | 6/1998 | Hutchison | |
| 5,769,419 | A | 6/1998 | Hill | |
| 6,530,571 | B1 * | 3/2003 | McWilliams | 273/244.2 |
| 6,651,984 | B1 | 11/2003 | Luken | |
| 7,398,973 | B2 | 7/2008 | Andrews | |
| 2004/0066002 | A1 | 4/2004 | Spring | |
| 2007/0246885 | A1 | 10/2007 | Timothy | |

* cited by examiner

*Primary Examiner*—Alvin A Hunter
*Assistant Examiner*—Dolores Collins
(74) *Attorney, Agent, or Firm*—Baker & Hostetler LLP

(57) ABSTRACT

A simulated football game that may be played using a deck comprising "run," "pass," and "catch" cards and other special football cards relating to moments of a football game or using an electronic device simulating such cards. Run cards may be played alone, while pass and catch cards must be played as corresponding pairs having corresponding yardages. An exemplary game allows scoring a touchdown by accumulating a drive of exactly 100 yards or scoring a field goal by playing a "field goal" card once the drive has advanced a predetermined number of yards. Some embodiments include variations of the game ranging from a one-drive game to a complete four quarter game. A specialized deck of cards is provided.

30 Claims, 7 Drawing Sheets

SIMULATED FOOTBALL GAME AND A DECK OF CARDS FOR PLAYING THE SAME

BACKGROUND

This invention relates to simulated sports games and decks of cards for playing simulated sports games. More particularly, the present invention relates to card or other game simulating the game of American football.

Sport simulation games in general and football simulation games in particular are known in the art. For example, U.S. Pat. Nos. 2,106,846, 2,460,541, and 5,040,796 and U.S. Patent Application Publication Nos. 2004/0066002 and 2007/0246885 disclose card games that simulate sports games.

SUMMARY

Exemplary embodiments of the present invention a simulated football game that may be played using a deck comprising "run," "pass," and "catch" cards or using an electronic device simulating such cards. Run cards may be played alone, while pass and catch cards must be played as corresponding pairs having corresponding yardages. An exemplary game allows scoring a touchdown by accumulating a drive of exactly 100 yards or scoring a field goal by playing a "field goal" card once the drive has advanced at least 70 yards. Some embodiments include beginning each drive with a "kickoff return" card and allowing players to obtain up to four additional cards representative of "downs."

In a first aspect, a method of playing a game may include dealing a plurality of cards from a deck of cards to each of a plurality of players, the deck of cards including a plurality of run cards, a plurality of pass cards, and a plurality of catch cards, and each of the run cards, pass cards, and catch cards including a yardage value; turning one card from the deck face-up to create a discard pile; where the players take a turn, each turn for each respective player including drawing one card from the deck or the discard pile; playing a run card or a corresponding pair of pass and catch cards, where the corresponding pair of pass and catch cards includes a pass card and a catch card having corresponding yardage values, and where playing includes creating a collection of cards such that a sum of the yardage values of any run cards in the collection and the yardage values of any corresponding pairs of pass and catch cards in the collection does not exceed a predetermined limit, and where creating a collection of cards having a sum equaling the predetermined limit results in the award of a touchdown score to the respective player; drawing at least one card from the deck to replace the played cards; and discarding one card to the discard pile unless the respective player was awarded the touchdown score on the turn.

In a detailed embodiment of the first aspect, the method may be implemented on an electronic system, and the run cards, the pass cards, and the catch cards may be displayed on a display device.

In another detailed embodiment of the first aspect, the method may be implemented using a deck of printed cards.

In another detailed embodiment of the first aspect, the method may include, prior to the step of dealing, the step of shuffling the deck of cards.

In another detailed embodiment of the first aspect, the predetermined limit may be 100 yards and the touchdown score may be 7 points.

In another detailed embodiment of the first aspect, the predetermined limit may be 50 yards.

In another detailed embodiment of the first aspect, the predetermined limit may be 110 yards.

In another detailed embodiment of the first aspect, the deck may include at least one field goal card, and playing the field goal card when the sum of the yardage values of the collection of cards is within a predetermined range of the predetermined limit may result in the award of a field goal score. In a further detailed embodiment, the predetermined range may be printed on the field goal card and the field goal score may be 3 points.

In another detailed embodiment of the first aspect, each of the players may take a plurality of turns until the deck is depleted a first time. In a further detailed embodiment, the method may include, after the deck is depleted the first time, gathering and shuffling any collections that resulted in a touchdown score or a field goal score and the discard pile to reform the deck. In a still further detailed embodiment, after the step of gathering and shuffling, the players may take a further plurality of turns until the deck is depleted a second time. In yet a further detailed embodiment, the method may include, after the deck is depleted a second time, gathering and shuffling all of the cards and repeating the steps of dealing the plurality of cards and turning one card face-up. In still a further detailed embodiment, after repeating the steps of dealing the plurality of cards and turning one card face-up, the players may take a further plurality of turns until the deck is depleted a third time. In yet a further detailed embodiment, the method may include, after the deck is depleted the third time, gathering and shuffling any collections that resulted in a touchdown score or a field goal score and the discard pile to reform the deck. In another detailed embodiment, the method may include determining a winner by identifying which of the players has a highest score.

In another detailed embodiment of the first aspect, at least one of the yardage values of at least one of the pass cards and the catch cards may include a yardage range, and any yardage value falling within the yardage range may be considered a corresponding yardage value.

In another detailed embodiment of the first aspect, the deck may include at least one opposing card, and the method may include presenting the opposing card, by one of the players, immediately following an other one of the players completing the step of playing a run card or a corresponding pair of pass and catch cards; and removing the run card or the corresponding pair of pass and catch cards from the collection.

In another detailed embodiment of the first aspect, the deck may include at least one opposing card, and the method may include presenting the opposing card, by one of the players, immediately following an other one of the players completing the step of playing one of one run card and one corresponding pair of pass and catch cards; and removing the collection on which the one of the run card and the corresponding pair of pass and catch cards was played.

In another detailed embodiment of the first aspect, the steps of playing one of one run card and one corresponding pair of pass and catch cards and drawing at least one card from the deck to replace the played cards may be repeated until the player no longer holds any run cards or corresponding pairs of pass and catch cards that may be added to the collection without the sum of the yardage values of the run cards and the corresponding pairs of pass and catch cards in the collection exceeding the predetermined limit.

In a second aspect, a method of playing a game may include providing a deck of cards including run cards, pass cards, and catch cards, where each of the run cards, pass cards, and catch cards includes a yardage value; dealing a first plurality of cards from the deck to each of a plurality of players to become each player's bench cards; dealing a second plurality of cards from the deck to each of the plurality of players to become each player's field cards; where the players take a turn, each turn for each player including playing any playable cards in the player's field cards, where playable cards include any run cards and any corresponding pairs of pass and catch cards, and where playing any playable cards includes placing any playable cards to create a drive; dealing at least one additional card from the deck into the player's field cards to replace the playable cards in the player's field cards; repeating the step of playing any playable cards in the player's field cards; playing any playable cards in the player's bench cards; where, at any time, if the sum of the yardage values of one player's drive exceeds a predetermined limit, eliminating the player from the game; where, at any time, if the sum of the yardage values of one player's drive equals the predetermined limit, awarding the player a touchdown score; where, at any time, if the sum of the yardage values of one player's drive is within a predetermined range of the predetermined limit and the player plays a field goal card, awarding the player a field goal score.

In a detailed embodiment of the second aspect, the method may be implemented on an electronic system, and the run cards, the pass cards, and the catch cards may be displayed on a display device.

In another detailed embodiment of the second aspect, the deck may include printed cards.

In another detailed embodiment of the second aspect, the method may include, after all of the players have completed their turns and if none of the players was awarded the touchdown score or the field goal score, allowing each of the players to selectively move one or more of the player's bench cards to the player's field cards, allowing a player having a longest drive to selectively remove one of the player's field cards, dealing a Hail Mary card, and determining whether any of the players merits a touchdown score or a field goal score and whether any of the players' drives exceeds the predetermined limit by applying the Hail Mary card to each of the players' field cards and playing any playable cards on each player's respective drive.

In another detailed embodiment of the second aspect, the method may include, before the step of dealing the first plurality of cards from the deck, shuffling the deck.

In another detailed embodiment of the second aspect, the predetermined limit may be 100 yards and the touchdown score may be 7 points.

In another detailed embodiment of the second aspect, the predetermined limit may be 50 yards.

In another detailed embodiment of the second aspect, the predetermined limit may be 110 yards.

In another detailed embodiment of the second aspect, the predetermined range may be printed on the field goal card and the field goal score may be 3 points.

In another detailed embodiment of the second aspect, at least one of the yardage values of at least one pass card or catch card may include a yardage range, and any yardage value falling within the yardage range may be considered a corresponding yardage value.

In another detailed embodiment of the second aspect, the method may include determining a winner by identifying which of the players has a highest score.

These and other features and advantages will become apparent to those skilled in the art upon consideration of the following detailed description of exemplary embodiments. The drawings are only to serve for reference and illustrative purposes, and are not intended to limit the scope of the disclosure.

BRIEF DESCRIPTION OF THE SEVERAL VIEWS OF THE DRAWINGS

The detailed description particularly refers to the accompanying figures in which.

DETAILED DESCRIPTION

Figure 1:
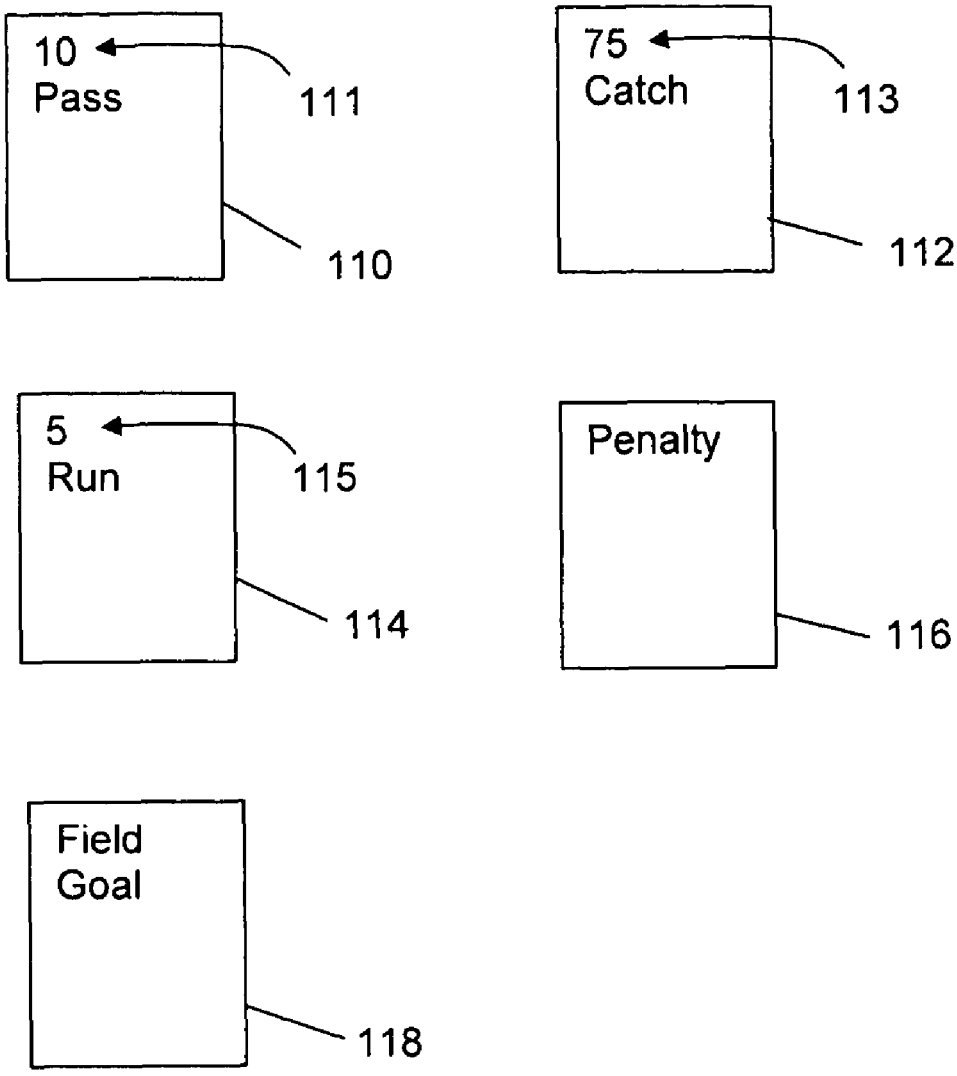
FIG. 1 depicts exemplary cards for use in exemplary games described herein.

A first exemplary game simulates the game of American football. In general, the object of this game is to accumulate points by scoring touchdowns, which occurs when a player advances exactly 100 yards. An embodiment of the first exemplary game is in the form of a two-player card game that uses a deck of cards including twenty "pass" cards (three 5 yard, four 10 yard, three 15 yard, three 20 yard, one 25 yard, one 30 yard, one 35 yard, one 40 yard, one 55 yard, one 60 yard, and one 75 yard), twenty "catch" cards (three 5 yard, four 10 yard, three 15 yard, three 20 yard, one 25 yard, one 30 yard, one 35 yard, one 40 yard, one 55 yard, one 60 yard, and one 75 yard), and twelve "run" cards (five 5 yard, two 10 yard, one 15 yard, one 20 yard, one 25 yard, one 30 yard, and one 40 yard).

FIG. 1 depicts exemplary cards, including a pass card 110, a catch card 112, a run card 114, a penalty card 116, and a field goal card 118. The pass card 110, catch card 112, and run card 114 include respective yardage values 111, 113, 115. It is to be understood that varying the composition of the deck (such as the number of each type of card, the yardages included on the cards, and the types of cards) is within the scope of the disclosure. Further, it is to be understood that employing alternative words on the cards is within the scope of the disclosure. For example, run cards may be called "running back" cards, pass cards may be called "quarterback" cards, and catch cards may be called "receiver" cards. In other embodiments, the cards may be called alternative names, while maintaining their function within the game. Further still, it is to be understood that the "yard" indicia and associated yardage value indicated on the cards may be replaced by meters or any other numeric or other indicia in some embodiments.

After shuffling the deck, each player is dealt three cards face-down. The deck is placed on the table between the players (face-down), and the top card is turned over and placed near the deck to create the discard pile. Players advance by playing the pass, catch, and run cards. The run cards may be played alone, while the pass and catch cards are played as a pair having corresponding yardages (e.g., a 20 yard pass card is played with a 20 yard catch card). The yardage gained by playing a run card is the yardage listed on the card, while the yardage gained by playing a corresponding pair of pass and catch cards is the corresponding yardage. For example, a 20 yard pass card played with a 20 yard catch card results in a gain of 20 yards.

The player scores a touchdown in the exemplary embodiment by advancing exactly 100 yards, and the total yardage of any drive may not exceed 100 yards. Thus, if a player has already advanced 90 yards, she may only play cards having yardage values of ten yards or less.

Figure 2:
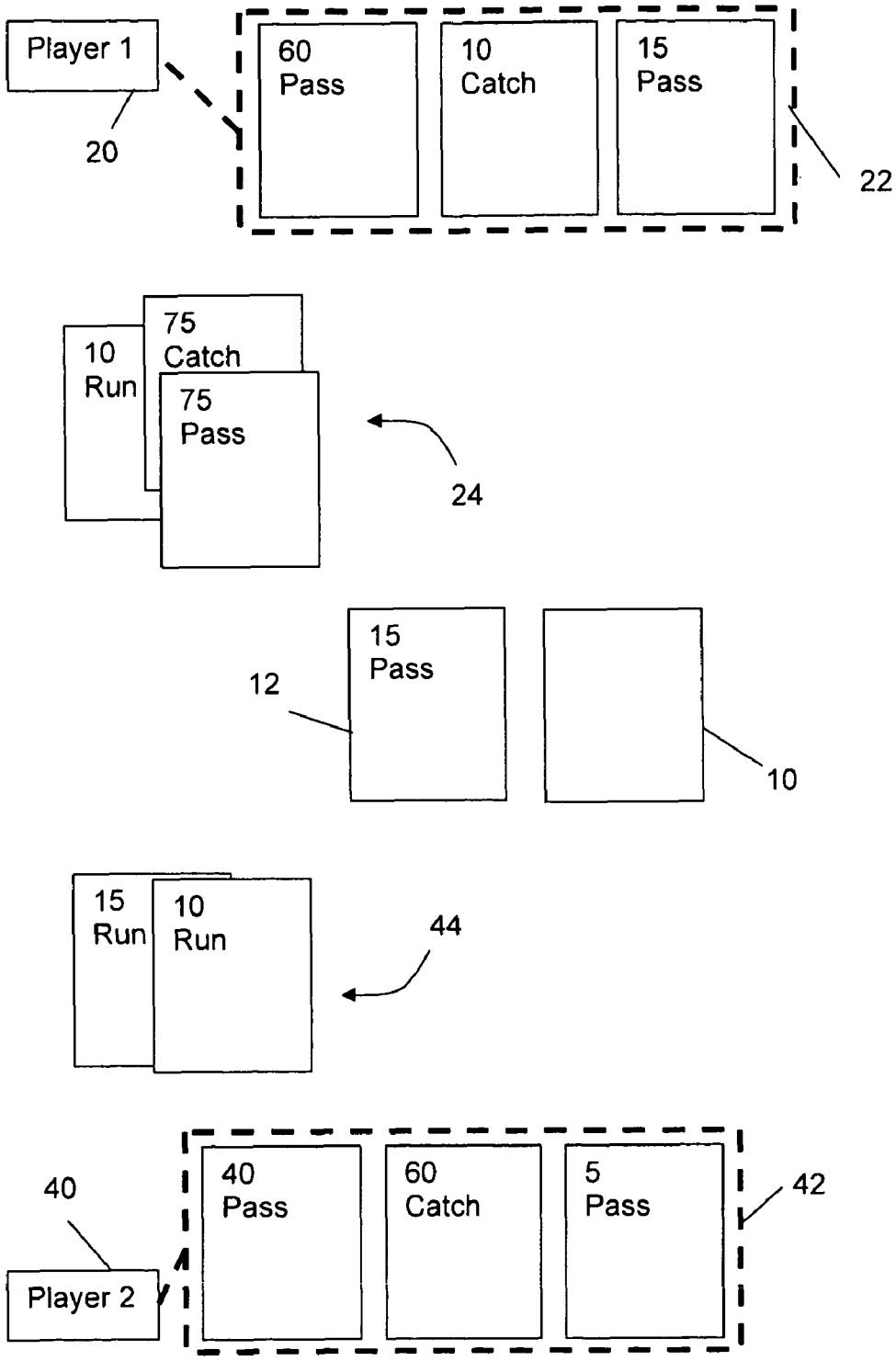
FIG. 2 is a schematic diagram of a first exemplary game.

Referring to FIG. 2, the first exemplary game is set up by dealing three cards to each player's 20, 40 hand 22, 42. The top card from the deck 10 is turned face up to start a discard pile 12.

Figure 3:
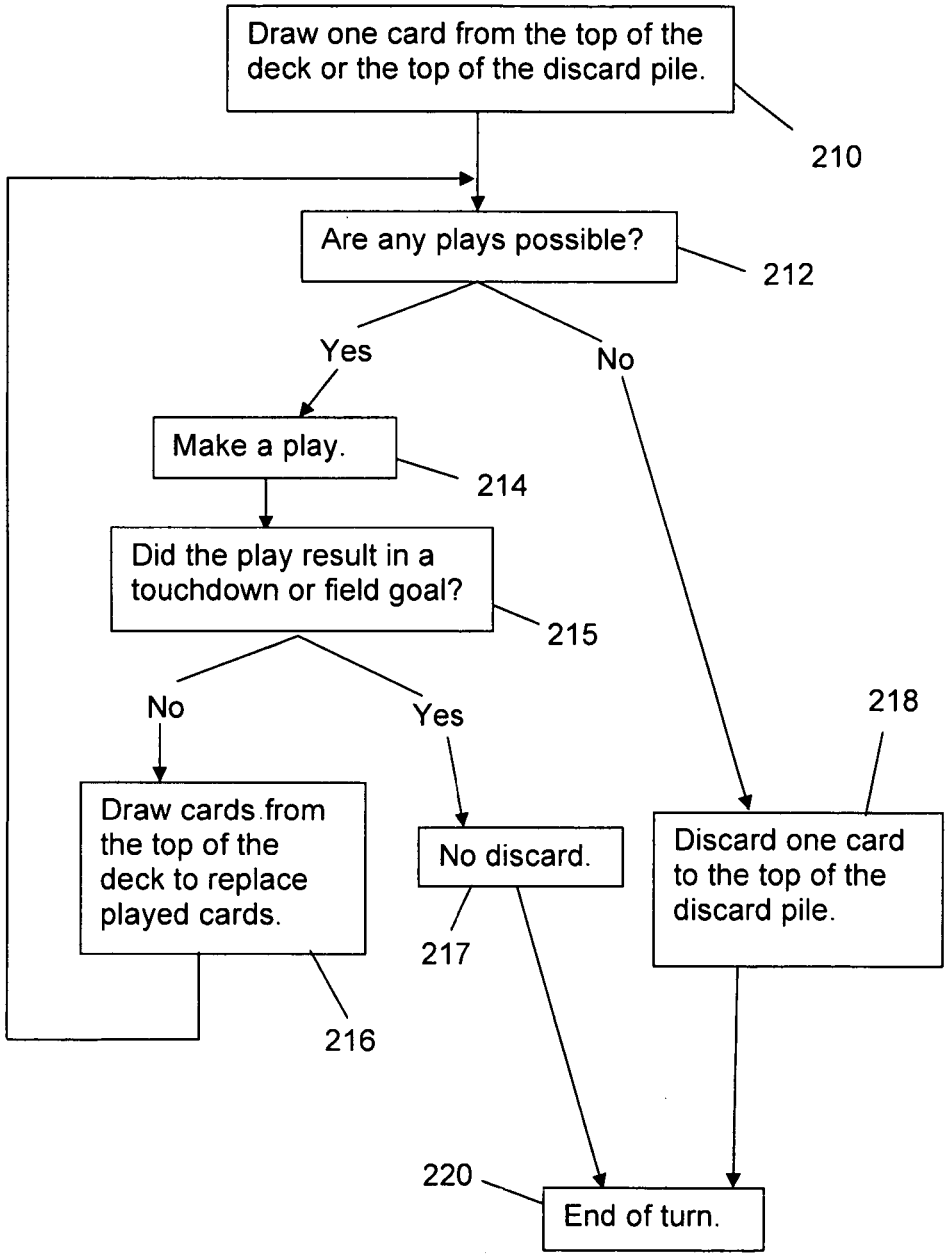
FIG. 3 is a flowchart showing an overview of a player's turn in the first exemplary game.

FIG. 3 is a flowchart depicting a player's turn. At the beginning of her turn, the first player 20 may draw the top card from the face-down deck 10 or she may pick up the top card from the discard pile 12 in step 210. In some cases, the player may need to draw two cards at the beginning of her turn (e.g., if she just played a penalty card against her opponent or if she scored a touchdown using corresponding pass and catch cards during her previous turn). More specifically, a player may end a turn with three or fewer cards remaining in her hand, and at the beginning of each turn may replenish her hand so as not to exceed four cards, gathering cards according to the rules. If a play is possible 212, the first player 20 makes a play 214 by playing either a run card or a corresponding pair of pass and catch cards. To play the cards, the player 20 places the cards face up in front of her to create a drive 24. If the play resulted in a touchdown or field goal (step 215), the player does not discard (step 217) and her turn ends (step 220). If the play did not result in a score 215, the player 20 draws from the deck 10 the number of cards played 216 (i.e., one card if a run card was played or two cards if a corresponding pair of pass and catch cards was played). The player 20 continues making plays 214 (adding to her drive 24) and drawing replacement cards 216 from the deck 10 until she is unable to make any further plays 212. At that point, she discards 218 one card to the discard pile 12 face-up and her turn ends 220.

The second player 40 then takes his turn, beginning with drawing the top card from the deck 10 or picking up the top card from the discard pile 12. The second player 40 makes plays on his drive 44 until he is no longer able to continue, at which time his turn ends and he discards one card to the discard pile face-up 12.

As each player 20, 40 plays his or her cards, the object is to create a drive 24, 44 that totals exactly 100 yards. Each completed 100 yard drive is a touchdown, which results in seven points. Once a player 20, 40 completes a drive for a touchdown, the completed drive 24, 44 is moved to the side and the player 20, 40 begins a new drive 24, 44.

The exemplary game lasts four quarters, where each quarter is one time through the deck 10. At the completion of the first quarter (the first time the deck 10 is depleted), the cards from the discard pile 12 and any completed drives 24, 44 (i.e., drives that have reached 100 yards) are picked up and shuffled together to reform the deck. Any in-progress drives 24, 44 are left on the table and the cards in the players' hands are retained.

At the completion of the second quarter (the second time the deck 10 is depleted), all of the cards are picked up (including any completed and any in-progress drives 24, 44 and the cards in the players' hands), shuffled together, and each player 20, 40 is dealt three cards into his or her hand 22, 42. The player 40 who went second at the beginning of the game starts the third quarter. At the completion of the third quarter (the third time the deck 10 is depleted), the cards from the discard pile 12 and any completed drives are picked up and shuffled together to reform the deck 10. At the completion of the fourth quarter (the fourth time the deck 10 is depleted), the player 20, 40 with the most points wins the game.

If the score is tied at the end of the fourth quarter, all cards are shuffled together and three cards are dealt to each player. Play continues in the same manner, except that the first player to score wins the game.

The deck 10 may include one or more cards other than the pass 110, catch 112, and run 114 cards. For example, it may include one "penalty" card 116, and one "field goal" card 118. A player may play the field goal card 118 to score three points anytime she has advanced at least a predetermined distance, such as 70 yards, in her current drive. Playing the field goal card 118 terminates the current drive and the player begins a new drive on her next turn. In some embodiments, other predetermined distances (or, similarly, predetermined ranges from the goal) may be utilized, and such predetermined distances or ranges may be printed on the field goal card 118.

A player may play the penalty card 116 only immediately following a play by her opponent (i.e., the penalty card is played before the opponent begins his next play). The penalty card 116 operates to negate the opponent's just-completed play. The cards relating to the negated play are set aside along with the penalty card 116, and negated cards and the penalty card 116 are shuffled into the deck at the end of the quarter.

Other cards may be included in the game. For example, a "pancake block" card may be played with a run card, resulting in doubling the yardage value of the run card. An "interception" card may be played against an opponent's pass play (when the opponent plays corresponding pass and catch cards, including when the play results in a touchdown), resulting in the removal of the opponent's entire drive. Similarly, a "fumble" card may be played against an opponent's pass or run play, resulting in the removal of the opponent's entire drive. A "sack" card may be played against an opponent's pass play, resulting in the removal of the that pass play. A "touchdown saving tackle" card may be played against an opponent's touchdown run or pass play that is 10 or more yards, resulting in the opponent beginning his next turn at the 5 yard line. A "kickoff return (50)" card may only be played on the first play of a drive, but it advances the drive a predetermined distance which may be printed on the card (e.g., to the 50 yard line). A "punt" card may be played when the drive has accumulated less than or equal to 70 yards, resulting in the removal of the player's current drive and the opponent having the next play. A "delay of game" card may be played against any play, resulting in a loss of the turn. A "safety" card may be played against an opponent beginning a play at his own 5 or 10-yard line, for example, resulting in two points for the defense. A "field goal block" card may be played against a field goal attempt, resulting in no score and a loss of the entire drive. A "pass deflection" card may be played against any pass play, resulting in no gain on that play. A "two point conversion" card may be played after a touchdown, resulting in eight total points for that particular touchdown. A "tackle for a loss" card may be played against a pass or run, resulting in the loss of a predetermined number of yards. It is within the scope of the disclosure to include other cards representing other football plays or other resulting consequences, for example. In general, as used herein, any card that may be played immediately following and against an opponent's play is referred to as an "opposing card."

As will be understood from the description above, players independently develop their drives and accumulate points in the exemplary embodiment (except in the case of special cards, such as the penalty card). Put another way, the exemplary embodiment focuses each player's attention on developing her own drive to score touchdowns and field goals, rather than on play-by-play (or down-by-down) competition between the players.

One or more of the pass or catch cards may indicate a range instead of a single yardage value. For example, a pass card with a yardage range may be played with any catch card having a yardage value falling within the yardage range of the pass card. An exemplary embodiment includes short pass cards (5-20 yards), medium pass cards (25-40 yards), and long pass cards (>45 yards) that may be played with a catch card having a yardage value that is within the respective range.

A four-player variation of the first exemplary game may be played in the same general manner as the two-player version. Team members sit opposite of each other and each add cards to the team's current drive. As in the two-player version, there are only two drives going on in the game, one for each team. In one exemplary embodiment, if one teammate wishes to pick up the most recently discarded card instead of drawing from the deck, the first teammate tells the second teammate to pick up the card. The second teammate then passes one card from her hand (which may be the card from the discard pile) to the first teammate. In another exemplary embodiment, two decks may be utilized and each time through the combined deck may correspond to one half of a football game. This embodiment may be more challenging to the players as it may be more difficult for the players to keep track of which cards have been played or discarded.

Another exemplary embodiment follows generally similar rules and utilizes two decks. Each team has its own deck and discard pile. The two decks are located in one row on the outside corners. The two discard piles are located next to one another in the middle and also next to their corresponding deck. At the beginning of each turn, a player has four choices:

1. Choose the top card from his own team's deck, and then make a play or discard.
2. Tell his teammate to "pick up the card." The teammate then picks up the top card from their team's discard pile. The player then must immediately decide to pass that particular card to his teammate, or keep the card, and give his teammate another one from his hand. When passing the card to the teammate, the card is kept face down. Play continues. The player adds that particular card to his hand. If he needs additional cards at that point, then the player draws the top card off the team's deck. A play or a discard is then made. If a play is made, then the process gets repeated.
3. A player may choose to take the top card from the opponent's discard pile. The player will then make a play, discard one of his own cards to his team's discard pile, keeping the opponent's card. The opponent's card cannot be played with his own drive. It can be kept in a player's hand, or discarded back to the opponents discard pile at the end of any future turn (instead of discarding his own card).
4. The other option is to pick up the top card of the opponent's deck. The card may be held in the player's hand indefinitely, or it may be discarded back to the opponent at the end of a future turn. The player continues with his current turn by either making a play or discarding one card.

In this embodiment, the quarters end when the first team no longer has any cards left in the deck and has made a play. At that point, all cards on the table are subject to the end of quarter rules discussed above. This means the team who did not get through the entire deck that quarter will not have access to all of their cards in that particular quarter.

In another exemplary embodiment, players may create custom decks. A suggested total number of cards and a suggested sub-total for each group of cards may be provided. Groups may include run, pass, catch, special, and defense, for example. Once the customized deck is created, the players may utilize the decks to play any of the games described herein.

A second exemplary game utilizes a similar deck of cards, but proceeds through a different course of play. One to four players may play with one deck, and five to eight players may play with two decks, for example.

In this second exemplary game, each hand represents a drive down the football field. The object of the game is to outscore the other players without accumulating a drive that exceeds 100 yards. A touchdown, which results in a score of seven points, occurs when a player accumulates a drive totaling exactly 100 yards. A player may play a field goal card once her drive reaches at least 70 yards, and a field goal results in score of three points. If a player is unable to score a touchdown or a field goal, the player attempts to achieve a longer drive than her opponents without exceeding 100 yards. If at any time a player accumulates a drive exceeding 100 yards, that player is eliminated from the game.

The game begins with each player being dealt three cards face-down, which are referred to as the "bench cards." Then, each player is dealt three cards face-up, which are referred to as the "field cards." During the game, the players hold and view the bench cards in their hands, without revealing the bench cards to the other players, and the field cards remain face-up on the table.

Starting with the player to the left of the dealer, each player may trade one or two of her bench cards for an equal number of cards from the top of the deck. The cards traded away are held aside until the next time the deck is shuffled. Players place traded-in bench cards face down to the side, and the dealer replaces the traded-in cards with an equal number of face-down cards. The new cards are added to the players' bench cards.

After each player has had an opportunity to trade bench cards, each player is dealt one card face-up from the top of the deck. This card is placed on the table in an "upside down" orientation and is referred to as the "kickoff return" card. Each player's kickoff return card is used as the first card in that player's drive. In alternative exemplary embodiments, kickoff return cards and/or yardages may not be utilized, and players may begin their respective drives as with a run card or a corresponding pair of pass and catch cards as described above.

Figure 5:
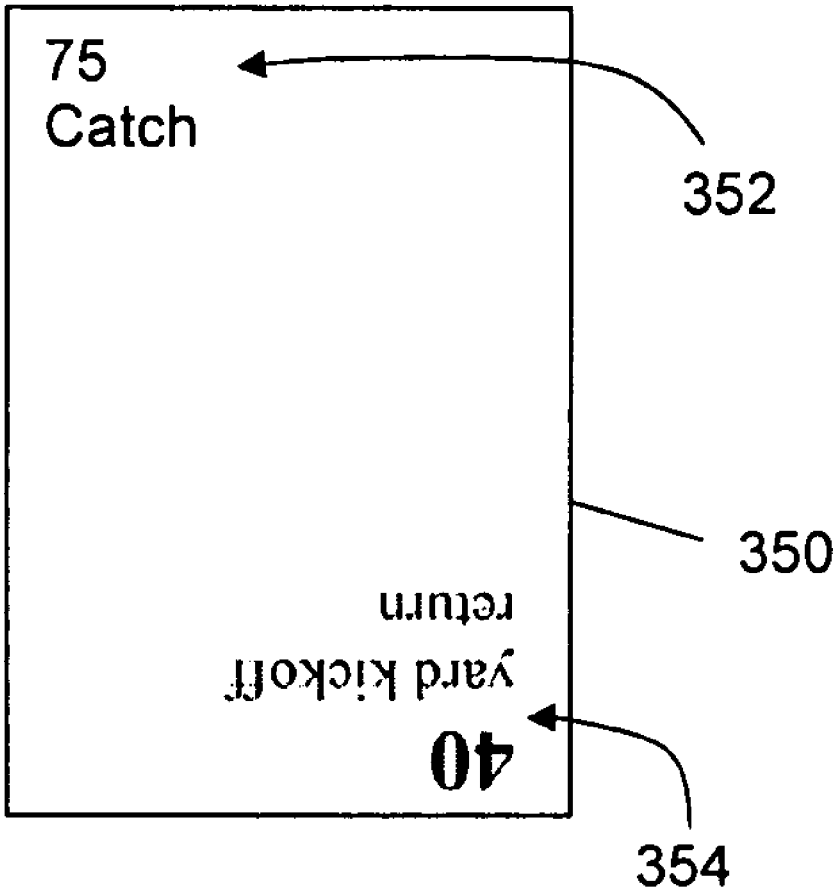
FIG. 5 depicts an exemplary card including a kickoff return yardage.

In an exemplary embodiment, the kickoff return yards are independent of the yardage for run, pass and catch. For example, a kickoff return yardage ranging from 5 to 40 yards may be located upside-down in the bottom right hand corner of every card, including field goal cards. See FIG. 5, which depicts an exemplary card 350 including a 75 yard catch marking 352 and a 40 yard kickoff return yardage marking 354.

In an exemplary embodiment of the game (a one-drive version), there may be only two cards in the deck with a kickoff return yardage that exceeds 25 yards (both are 40 yard returns), and both are located on the 75 yard pass and 75 yard catch cards. Thus, there is no way a kickoff return and another single play could "bust" a player (put them over 100 yards). The next highest plays in the deck (60 yards pass/60 yards catch) have 25-yard kickoff returns. If a player gets a 25-yard kickoff return and plays a 75 yard pass and catch pair, the player scores a touchdown. Likewise, the 40 yard kickoff return (located on the 75 yard pass and catch cards) can be paired with a 60 yard pass and catch pair.

Figure 4:
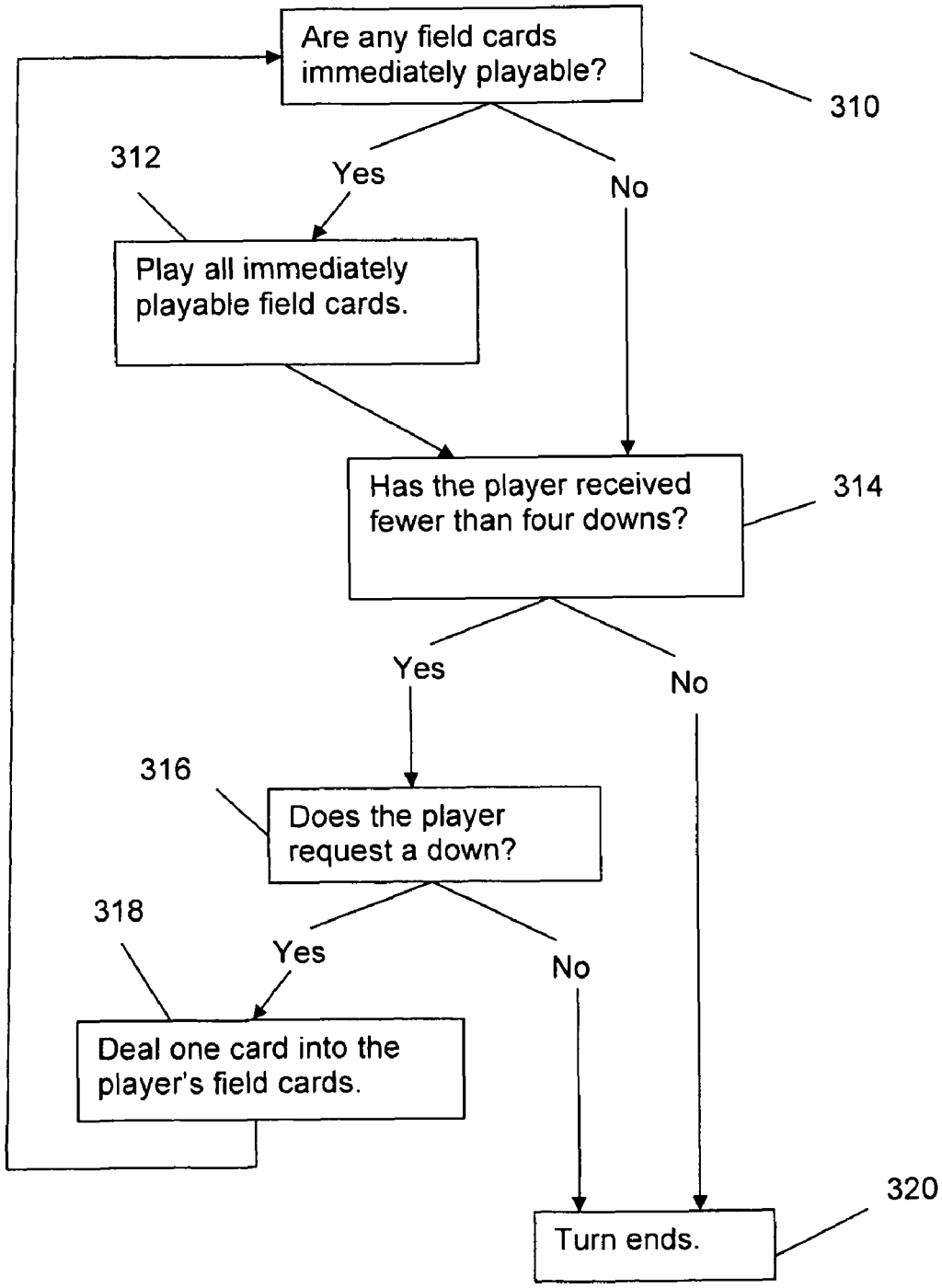
FIG. 4 is a flowchart showing an overview of a player's turn in the second exemplary game.

Play commences in clockwise order, beginning to the dealer's left. As depicted in FIG. 4, any field cards that are immediately playable 310 must be played on the drive 312. Playable cards are any run cards or any corresponding pairs of pass and catch cards. Players may play their bench cards at any time, either alone, with other bench cards, or with cards from the field cards.

Additionally, each player may request 316 up to four 314 "downs" from the dealer. Each down is a card that is dealt face-up and becomes part of the player's field cards 318. As downs are dealt, any playable cards 310 must be immediately moved to the player's drive 310, even if this causes the player's drive to exceed 100 yards (which would eliminate the player from the game). Once the player decides to "hold" (take no more of her possible four downs) or after all four downs have been dealt, play continues with the next clockwise player 320.

Once all players have decided to hold or have exhausted their four downs, play continues with "final plays." In clockwise order beginning to the left of the dealer, each player may use any of her remaining bench cards (alone or in combination with any remaining field cards) to improve her field position and/or score.

Once all of the players have completed their final plays, a winner is determined. The high score wins the game. If two or more players have equal scores, the game is declared a tie. If no player scores, the players prepare for a "Hail Mary" card. Each player chooses whether to move any or all of her bench cards to her field cards. Any remaining bench cards are out of play and are set aside. Then, the player with the longest drive may remove one card of her choice from her field cards. The dealer then reveals the top card from the deck, which is the Hail Mary card. The Hail Mary card is a "community" card that is played by all of the players. Incorporating the Hail Mary card into each player's field cards will have no effect, help the player gain yardage, help the player to score, or cause the player to be eliminated from the game by exceeding 100 yards. The winner is determined with the Hail Mary card included in each player's field cards. If no player has scored, the player with the longest drive is the winner. If two or more players have yardages that equal the longest drive, the game is declared a tie.

In general, exemplary embodiments employ a built in time clock feature that relates simulation game play to the time limitations placed on the actual sport. For example, the exemplary American football games described above relate one pass through the deck of cards to one quarter of an actual football game. In an exemplary embodiment utilizing two decks, one pass through the composite deck may represent one half of an American football game. In other embodiments, one pass (or several passes) through the deck may relate to one of the three periods in a hockey game, a half or a quarter of a basketball game, a half of a soccer game, etc., for example.

Figure 6:
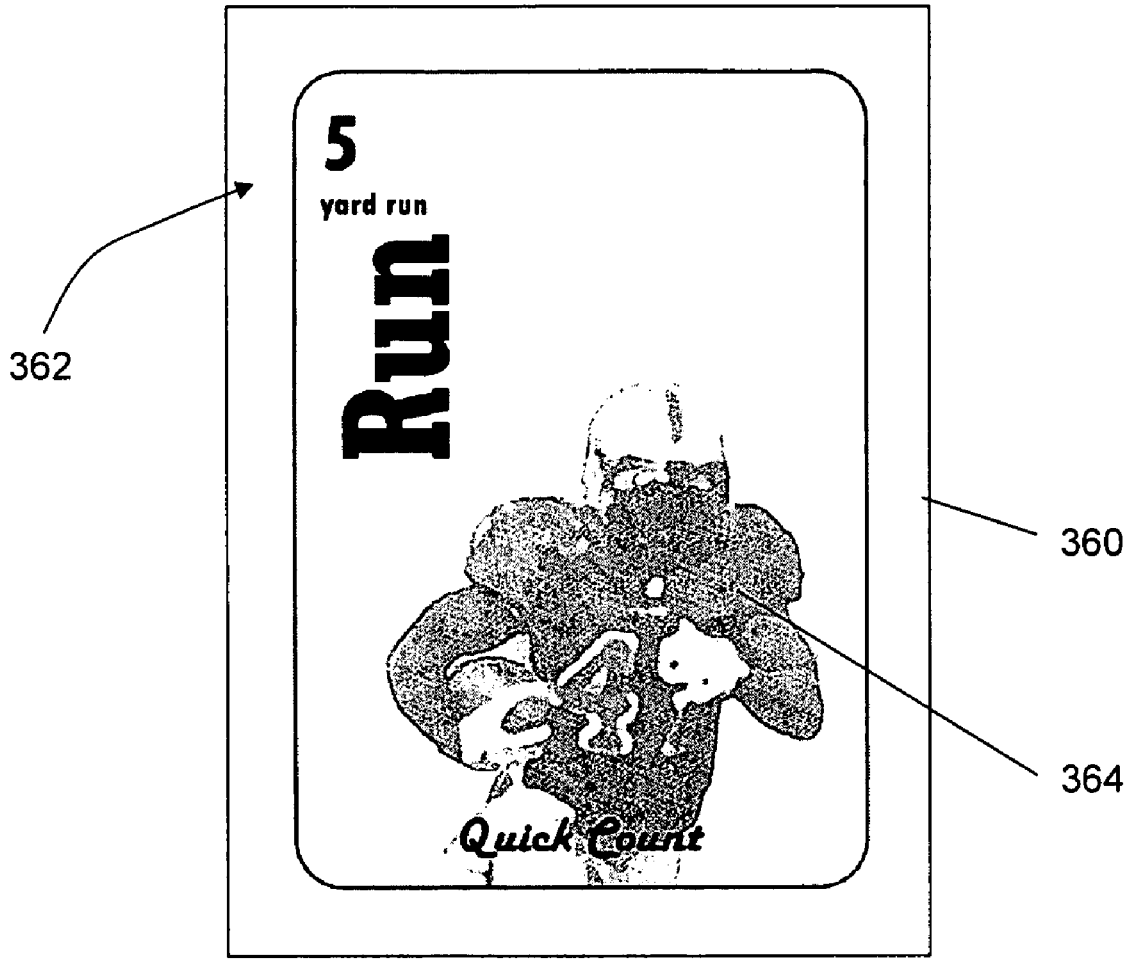
FIG. 6 depicts an exemplary card including a decorative image.

FIG. 6 depicts an exemplary run card 360 including a 5 yard run marking 362 and a decorative image 364. Notably, in this exemplary card, the marking 362 is located at the upper left corner of the card and "Run" is printed vertically. Such an arrangement allows easy fanning several cards in a player's hand. The decorative image 364 may relate to the type of card. For example, decorative image 364 depicts a football player running with a football, which relates to run card 360. In general, it is within the scope of the disclosure to utilize decorative images on any or all of the cards, and such images may relate to the type of card.

While the exemplary embodiments described herein have included card-based implementations of exemplary games, other exemplary embodiments may include electronic gaming devices and electronic systems (such as, but not limited to, the Internet, mobile phones, gaming devices, slot machines, computers, etc.). It is within the scope of this disclosure to implement games utilizing electronic components or printed materials other than cards. For example, exemplary games may be played on a personal computer, game system, or gaming machine (such as a slot machine) in a stand-alone capacity or utilizing a communications network, such as the internet. As an example, computers and/or game systems may be utilized to play exemplary games where the players are geographically separated, and exemplary games may be played on networked gaming machines (such as slot machines) in a casino, for example. In other embodiments, exemplary games may be played utilizing mobile devices, such as mobile phones, personal digital assistants, or portable video game devices, for example. In a stand-alone or networked capacity, exemplary games may be provided on electronic equipment adapted specifically for gaming. Such devices may be used, for example, in a video game arcade, a bar/restaurant, and/or a casino. It is to be understood that implementations of games on electronic systems may include representations of representations of any aspect of a game, including any cards, drives, hands, bench cards, field cards, discard piles, decks, etc.

In another exemplary embodiment, an exemplary game may utilize scratch-off printed materials, such as scratch-off lottery tickets. In such an embodiment, one or more card images may be provided beneath one or more scratch-off portions, for example. In some embodiments, a player may choose one or more areas of a scratch-off portion to remove. In an exemplary American football embodiment, a player may remove one or more scratch-off portions covering card images corresponding to cards (which may include pass, catch, and/or run cards, for example) that may be included in a drive as described herein. Exemplary scratch-off portions or areas may include representations of any aspect of a game, including any cards, drives, hands, bench cards, field cards, discard piles, decks, etc. Exemplary scratch-off games may utilize different payouts corresponding to different game outcomes. For example, a highest payout may correspond to a touchdown, a next payout may correspond to a field goal, and a third payout may correspond to a drive yardage (such as a longest drive or a drive exceeding a predetermined amount).

Exemplary methods may be implemented in the general context of computer-executable instructions that may run on one or more computers, and exemplary methods may also be implemented in combination with program modules and/or as a combination of hardware and software. Generally, program modules include routines, programs, components, data structures, etc., that perform particular tasks or implement particular abstract data types. Moreover, those skilled in the art will appreciate that exemplary methods can be practiced using or with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices. Exemplary methods may also be practiced in distributed computing environments where certain tasks are performed by remote processing devices that are linked through a communications network. In a distributed computing environment, program modules can be located in both local and remote memory storage devices.

An exemplary computer typically includes a variety of computer readable media. Computer readable media can be any available media that can be accessed by the computer and includes volatile and non-volatile media, removable and non-removable media. By way of example, and not limitation, computer-readable media can comprise computer storage media and communication media. Computer storage media includes volatile and non-volatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD ROM, digital video disk (DVD) or other optical disk storage, magnetic cassettes, magnetic tape, magnetic disk storage or other magnetic storage devices, or any other medium which can be used to store the desired information and which can be accessed by the computer.

Figure 7:
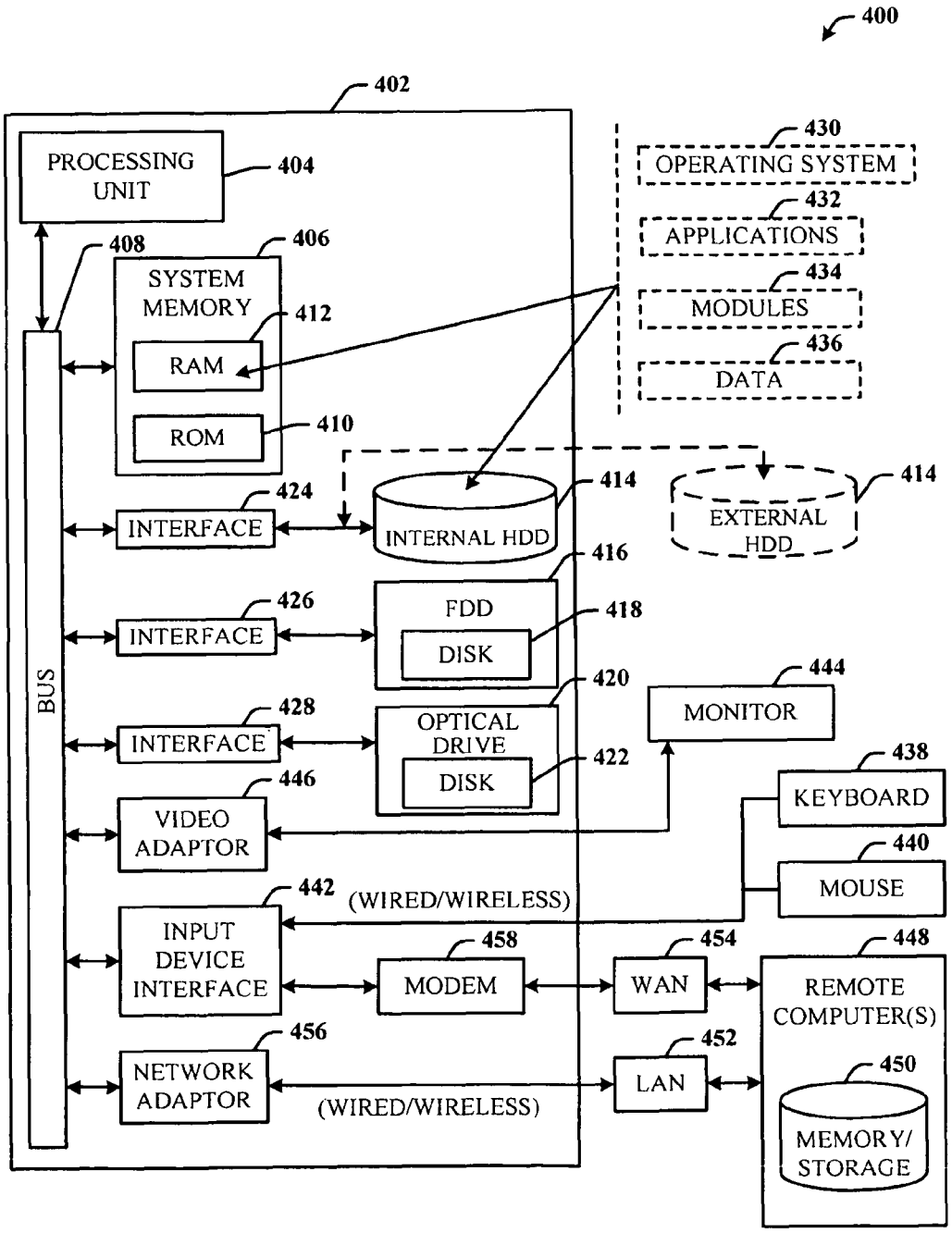
FIG. 7 is a schematic diagram of an exemplary computer system which may be used to perform exemplary methods.

With reference to FIG. 7, an exemplary computing system 400 includes a computer 402 including a processing unit 404, a system memory 406, and a system bus 408. The system bus 408 provides an interface for system components including, but not limited to, the system memory 406 to the processing unit 404. The processing unit 404 can be any of various commercially available processors, for example. Dual microprocessors and other multi processor architectures may also be employed as the processing unit 404. The system bus 408 can be any of several types of bus structure that may further interconnect to a memory bus (with or without a memory controller), a peripheral bus, and a local bus using any of a variety of commercially available bus architectures. The system memory 406 includes read-only memory (ROM) 410 and random access memory (RAM) 412. A basic input/output system (BIOS) is stored in a non-volatile memory 410 such as ROM, EPROM, EEPROM, which BIOS contains the basic routines that help to transfer information between elements within the computer 402, such as during start-up. The RAM 412 can also include a high-speed RAM such as static RAM for caching data.

The computer 402 further includes an internal hard disk drive (HDD) 414 (e.g., EIDE, SATA), which internal hard disk drive 414 may also be configured for external use in a suitable chassis (not shown), a magnetic floppy disk drive (FDD) 416, (e.g., to read from or write to a removable diskette 418) and an optical disk drive 420, (e.g., reading a CD-ROM disk 422 or, to read from or write to other high capacity optical media such as the DVD). The hard disk drive 414, magnetic disk drive 416 and optical disk drive 420 can be connected to the system bus 408 by a hard disk drive interface 424, a magnetic disk drive interface 426 and an optical drive interface 428, respectively. The interface 424 for external drive implementations includes at least one or both of Universal Serial Bus (USB) and IEEE 1394 interface technologies.

The drives and their associated computer-readable media provide nonvolatile storage of data, data structures, computer-executable instructions, and so forth. For the computer 402, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing novel methods of the disclosed architecture.

A number of program modules can be stored in the drives and RAM 412, including an operating system 430, one or more application programs 432, other program modules 434 and program data 436. All or portions of the operating system, applications, modules, and/or data can also be cached in the RAM 412. It is to be appreciated that the disclosed architecture can be implemented with various commercially available operating systems or combinations of operating systems.

A user can enter commands and information into the computer 402 through one or more wire/wireless input devices, for example, a keyboard 438 and a pointing device, such as a mouse 440. Other input devices (not shown) may include a microphone, an IR remote control, a joystick, a game pad, a stylus pen, touch screen, button(s), slot machine lever, or the like. These and other input devices are often connected to the processing unit 404 through an input device interface 442 that is coupled to the system bus 408, but can be connected by other interfaces, such as a parallel port, an IEEE 1394 serial port, a game port, a USB port, an IR interface, etc.

A monitor 444 or other type of display device is also connected to the system bus 408 via an interface, such as a video adapter 446. In addition to the monitor 444, a computer typically includes other peripheral output devices (not shown), such as speakers, printers, etc.

The computer 402 may operate in a networked environment using logical connections via wire and/or wireless communications to one or more remote computers, such as a remote computer(s) 448. The remote computer(s) 448 can be a workstation, a server computer, a router, a personal computer, portable computer, microprocessor-based entertainment appliance, a peer device or other common network node, and typically includes many or all of the elements described relative to the computer 402, although, for purposes of brevity, only a memory/storage device 450 is illustrated. The logical connections depicted include wire/wireless connectivity to a local area network (LAN) 452 and/or larger networks, for example, a wide area network (WAN) 454. Such LAN and WAN networking environments are commonplace in offices and companies, and facilitate enterprise-wide computer networks, such as intranets, all of which may connect to a global communications network, for example, the Internet.

When used in a LAN networking environment, the computer 402 is connected to the local network 452 through a wire and/or wireless communication network interface or adapter 456. The adaptor 456 may facilitate wire or wireless communication to the LAN 452, which may also include a wireless access point disposed thereon for communicating with the wireless adaptor 456. When used in a WAN networking environment, the computer 402 can include a modem 458, or is connected to a communications server on the WAN 454, or has other means for establishing communications over the WAN 454, such as by way of the Internet. The modem 458, which can be internal or external and a wire and/or wireless device, is connected to the system bus 408 via the serial port interface 442. In a networked environment, program modules depicted relative to the computer 402, or portions thereof, can be stored in the remote memory/storage device 450. It will be appreciated that the network connections shown are exemplary and other means of establishing a communications link between the computers can be used.

The computer 402 is operable to communicate with any wireless devices or entities operatively disposed in wireless communication, for example, a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi and Bluetooth™ wireless technologies. Thus, the communication can be a predefined structure as with a conventional network or simply an ad hoc communication between at least two devices. Wi-Fi, or Wireless Fidelity, allows connection to the Internet from a couch at home, a bed in a hotel room, or a conference room at work, without wires. Wi-Fi is a wireless technology similar to that used in a cell phone that enables such devices, for example, computers, to send and receive data indoors and out; anywhere within the range of a base station. Wi-Fi networks use radio technologies called IEEE 802.11x (a, b, g, etc.) to provide secure, reliable, fast wireless connectivity. A Wi-Fi network can be used to connect computers to each other, to the Internet, and to wired networks (which use IEEE 802.3 or Ethernet).

Although the exemplary embodiments described herein have referenced 100 yards as the length of a drive required to score a touchdown, it is within the scope of this disclosure to utilize any predetermined total yardage. For example, a game simulating arena football may utilize a total yardage of 50 yards, while a game simulating Canadian football may utilize a total yardage of 110 yards.

Further, it will be understood by those of skill in the art that similar methods of play could be utilized in a game simulating a sport other than American football. For example, the methods of play disclosed herein could be utilized in games simulating rugby, soccer, hockey, basketball, etc. In such embodiments, the names of the cards may be adapted to the particular sport. For example, in a basketball embodiment, a "3-point shot" card may operate in a manner generally similar to the field goal card of an American football embodiment. Similarly, in a soccer embodiment, a "catch" card may be renamed "trap," "receive," or another appropriate term, for example.

In some exemplary embodiments, players may be permitted to wager at one or more points during the game. For example, players may be permitted to wager prior to the game (i.e., before the cards are dealt), after the initial deal of the bench and field cards, after any of the field cards are initially added to the kickoff return card, after all of the player have taken their four downs, and/or after final plays are made to determine a winner, and just before the Hail Mary process, if no player previously scored.

While exemplary embodiments have been set forth above for the purpose of disclosure, modifications of the disclosed embodiments as well as other embodiments thereof may occur to those skilled in the art. Accordingly, it is to be understood that the inventions contained herein are not limited to the above precise embodiments and that changes may be made without departing from the scope of the disclosure. Likewise, it is to be understood that it is not necessary to meet any or all of the stated advantages or objects disclosed herein to fall within the scope of the disclosure, since inherent and/or unforeseen advantages of the present disclosure may exist even though they may not have been explicitly discussed herein.

What is claimed is:

1. A method of playing a game comprising:

dealing a plurality of cards from a deck of cards to each of a plurality of players, wherein the deck of cards includes a plurality of run cards, a plurality of pass cards, and a plurality of catch cards, wherein each of the run cards, pass cards, and catch cards includes a yardage value;

turning one card from the deck face-up to create a discard pile on a table;

wherein the players take a turn, each turn for each respective player including drawing one card from one of the deck and the discard pile;

playing one of one run card and one corresponding pair of pass and catch cards, wherein the corresponding pair of pass and catch cards includes a pass card and a catch card having corresponding yardage values, and wherein playing includes creating a collection of cards such that a sum of the yardage values of any run cards in the collection and the yardage values of any corresponding pairs of pass and catch cards in the collection does not exceed a predetermined limit, and wherein creating a collection of cards having a sum equaling the predetermined limit results in the award of a touchdown score to the respective player;

drawing at least one card from the deck to replace the played cards; and discarding one card to the discard pile unless the respective player was awarded the touchdown score on the turn.

2. The method of claim 1, wherein the method is implemented using a deck of printed cards.

3. The method of claim 1, further comprising, prior to the step of dealing, the step of shuffling the deck of cards.

4. The method of claim 1, wherein the predetermined limit is 100 yards and the touchdown score is 7 points.

5. The method of claim 1, wherein the predetermined limit is 50 yards.

6. The method of claim 1, wherein the predetermined limit is 110 yards.

7. The method of claim 1, wherein the deck includes at least one field goal card, wherein playing the field goal card when the sum of the yardage values of the collection of cards is within a predetermined range of the predetermined limit results in the award of a field goal score.

8. The method of claim 7, wherein the predetermined range is printed on the field goal card and the field goal score is 3 points.

9. The method of claim 1, wherein each of the players takes a plurality of turns until the deck is depleted a first time.

10. The method of claim 9, further comprising, after the deck is depleted the first time, gathering and shuffling any collections that resulted in a touchdown score or a field goal score and the discard pile to reform the deck.

11. The method of claim 10, wherein, after the step of gathering and shuffling, the players take a further plurality of turns until the deck is depleted a second time.

12. The method of claim 11, further comprising, after the deck is depleted a second time, gathering and shuffling all of the cards and repeating the steps of dealing the plurality of cards and turning one card face-up.

13. The method of claim 12, wherein, after repeating the steps of dealing the plurality of cards and turning one card face-up, the players take a further plurality of turns until the deck is depleted a third time.

14. The method of claim 13, further comprising, after the deck is depleted the third time, gathering and shuffling any collections that resulted in a touchdown score or a field goal score and the discard pile to reform the deck.

15. The method of claim 9, further comprising, determining a winner by identifying which of the players has a highest score.

16. The method of claim 1, wherein at least one of the yardage values of at least one of the pass cards and the catch cards includes a yardage range, wherein any yardage value falling within the yardage range is considered a corresponding yardage value.

17. The method of claim 1, wherein the deck includes at least one opposing card, and the method further includes presenting the opposing card, by one of the players, immediately following an other one of the players completing the step of playing one of one run card and one corresponding pair of pass and catch cards; and removing the one of the one run card and the one corresponding pair of pass and catch cards from the collection.

18. The method of claim 1, wherein the deck includes at least one opposing card, and the method further includes presenting the opposing card, by one of the players, immediately following an other one of the players completing the step of playing one of one run card and one corresponding pair of pass and catch cards; and removing the collection on which the one of the run card and the corresponding pair of pass and catch cards was played.

19. The method of claim 1, wherein the steps of playing one of one run card and one corresponding pair of pass and catch cards and drawing at least one card from the deck to replace the played cards are repeated until the player no longer holds any run cards or corresponding pairs of pass and catch cards that may be added to the collection without the sum of the yardage values of the run cards and the corresponding pairs of pass and catch cards in the collection exceeding the predetermined limit.

20. A method of playing a game comprising:

providing a deck of cards including run cards, pass cards, and catch cards, wherein each of the run cards, pass cards, and catch cards includes a yardage value;

dealing a first plurality of cards from the deck to each of a plurality of players to become each player's bench cards;

dealing a second plurality of cards from the deck to each of the plurality of players to become each player's field cards;

wherein the players take a turn, each turn for each player including playing any playable cards in the player's field cards, wherein playable cards include any run cards and any corresponding pairs of pass and catch cards, and wherein playing any playable cards includes placing any playable cards to create a drive on a table;

dealing at least one additional card from the deck into the player's field cards to replace the playable cards in the player's field cards;

repeating the step of playing any playable cards in the player's field cards;

playing any playable cards in the player's bench cards;

wherein, at any time, if the sum of the yardage values of one player's drive exceeds a predetermined limit, eliminating the player from the game;

wherein, at any time, if the sum of the yardage values of one player's drive equals the predetermined limit, awarding the player a touchdown score;

wherein, at any time, if the sum of the yardage values of one player's drive is within a predetermined range of the predetermined limit and the player plays a field goal card, awarding the player a field goal score.

21. The method of claim 20, wherein the deck includes printed cards.

22. The method of claim 21, further comprising, after all of the players have completed their turns and if none of the players was awarded the touchdown score or the field goal score, allowing each of the players to selectively move one or more of the player's bench cards to the player's field cards, allowing a player having a longest drive to selectively remove one of the player's field cards, dealing a Hail Mary card, and determining whether any of the players merits a touchdown score or a field goal score and whether any of the players' drives exceeds the predetermined limit by applying the Hail Mary card to each of the players' field cards and playing any playable cards on each player's respective drive.

23. The method of claim 20, further comprising, before the step of dealing the first plurality of cards from the deck, shuffling the deck.

24. The method of claim 20, wherein the predetermined limit is 100 yards and the touchdown score is 7 points.

25. The method of claim 20, wherein the predetermined limit is 50 yards.

26. The method of claim 20, wherein the predetermined limit is 110 yards.

27. The method of claim 20, wherein the predetermined range is printed on the field goal card and the field goal score is 3 points.

28. The method of claim 20, wherein at least one of the yardage values of at least one of the pass cards and the catch cards includes a yardage range, wherein any yardage value falling within the yardage range is considered a corresponding yardage value.

29. The method of claim 20, further comprising determining a winner by identifying which of the players has a highest score.

30. A non-transitory computer-readable medium having encoded thereon software programmed to cause a computer to perform a method for playing a game, comprising the steps of:

dealing a plurality of cards from a deck of cards to each of a plurality of players, wherein the deck of cards includes a plurality of run cards, a plurality of pass cards, and a plurality of catch cards, wherein each of the run cards, pass cards, and catch cards includes a yardage value;

turning one card from the deck face-up to create a discard pile;

wherein the players take a turn, each turn for each respective player including drawing one card from one of the deck and the discard pile;

playing one of one run card and one corresponding pair of pass and catch cards, wherein the corresponding pair of pass and catch cards includes a pass card and a catch card having corresponding yardage values, and wherein playing includes creating a collection of cards such that a sum of the yardage values of any run cards in the collection and the yardage values of any corresponding pairs of pass and catch cards in the collection does not exceed a predetermined limit, and wherein creating a collection of cards having a sum equaling the predetermined limit results in the award of a touchdown score to the respective player;

drawing at least one card from the deck to replace the played cards; and discarding one card to the discard pile unless the respective player was awarded the touchdown score on the turn; and wherein the run cards, the pass cards, and the catch cards are displayed on a display device.

* * * * *